US007604159B2

(12) United States Patent
Novak et al.

(10) Patent No.: US 7,604,159 B2
(45) Date of Patent: Oct. 20, 2009

(54) METHOD AND CALCULATOR FOR CONVERTING CONCRETE REINFORCING MATERIALS TO AN EQUIVALENT QUANTITY OF CONCRETE REINFORCING FIBERS

(75) Inventors: Jeff Novak, Kennesaw, GA (US); Jeff Rodencal, Marietta, GA (US)

(73) Assignee: NV Bekaert SA, Zwevegem (BE)

( * ) Notice: Subject to any disclaimer, the term of this patent is extended or adjusted under 35 U.S.C. 154(b) by 874 days.

(21) Appl. No.: 11/070,211

(22) Filed: Mar. 3, 2005

(65) Prior Publication Data

US 2006/0196145 A1 Sep. 7, 2006

(51) Int. Cl.
*G06G 1/00* (2006.01)

(52) U.S. Cl. ..... 235/70 R; 235/375

(58) Field of Classification Search ..... 235/70 R, 235/375

See application file for complete search history.

(56) References Cited

U.S. PATENT DOCUMENTS

| | | | | |
|---|---|---|---|---|
| 3,814,308 | A * | 6/1974 | Kolan | 235/70 R |
| D370,494 | S | 6/1996 | Hughes et al. | |
| 5,678,862 | A | 10/1997 | Hughes et al. | |
| 6,045,910 | A | 4/2000 | Lambrechts | |
| 6,269,602 | B1 | 8/2001 | Thooft et al. | |

OTHER PUBLICATIONS

Dean Foods 401(K) Plan "Scorecard/Crunching the numbers", © 2002 MFS Investment Management®, MFS Fund Distributors, Inc., Boston, Massachusetts 02116, USA, (DEAN-SR-04/02/12M)(16 pages).

Wachovia "Traveler's Check Verification", © 2002 Abagnale & Associates (800-237-7442) (24 pages).

Union Wire Rope "Ton-Mile Indicator", Union Wire Rope/Division of Wire Rope Corporation of America, Incorporated, St.Joseph, Missouri 64501, USA, undated (12 pages).

* cited by examiner

*Primary Examiner*—Karl D. Frech
(74) *Attorney, Agent, or Firm*—Shlesinger Arkwright & Garvey LLP

(57) ABSTRACT

Method for converting a first type of concrete reinforcing material to an equivalent quantity of concrete reinforcing fibers for designing a reinforced concrete slab. Fibers may be steel or other materials. User determines whether a slab to be reinforced is a lightly reinforced slab; and then uses spacing theory to get a minimum fiber dosage for a given concrete slab thickness, if the slab is a lightly reinforced slab. User then uses an equivalent area of steel calculation to determine proper fiber dosage, if the minimum fiber dosage for a given concrete slab thickness is insufficient to give a residual strength factor greater than 30 percent. If minimum fiber dosage for a given concrete slab thickness suffices to give a residual strength factor greater than 30 percent, then user uses equivalent moment capacity calculation to determine a proper fiber dosage. Concrete design calculator may incorporate method and values.

18 Claims, 2 Drawing Sheets

FIG. 2

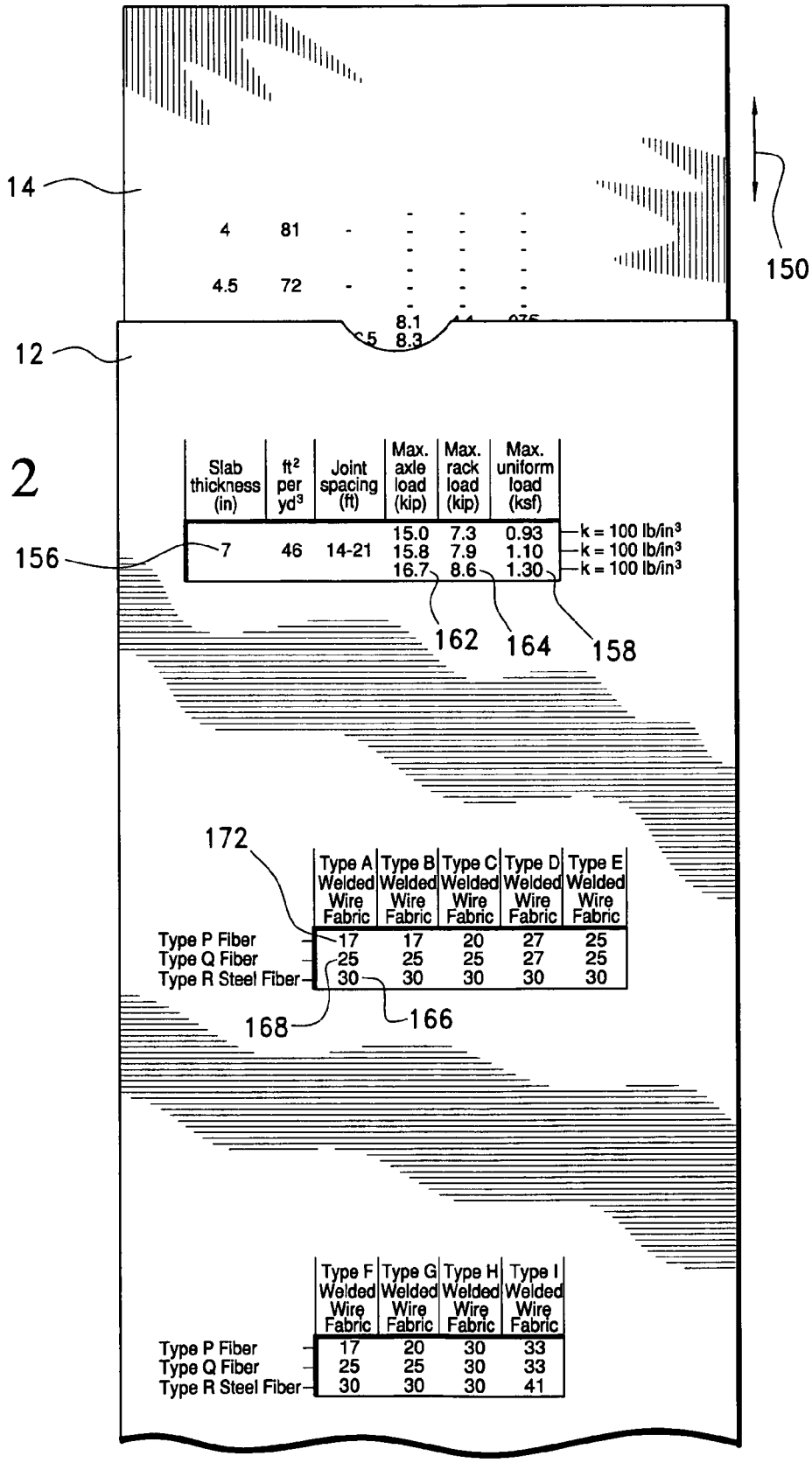

| Slab thickness (in) | ft² per yd³ | Joint spacing (ft) | Max. axle load (kip) | Max. rack load (kip) | Max. uniform load (ksf) | |
|---|---|---|---|---|---|---|
| 7 | 46 | 14-21 | 15.0 | 7.3 | 0.93 | k = 100 lb/in³ |
| | | | 15.8 | 7.9 | 1.10 | k = 100 lb/in³ |
| | | | 16.7 | 8.6 | 1.30 | k = 100 lb/in³ |

| | Type A Welded Wire Fabric | Type B Welded Wire Fabric | Type C Welded Wire Fabric | Type D Welded Wire Fabric | Type E Welded Wire Fabric |
|---|---|---|---|---|---|
| Type P Fiber | 17 | 17 | 20 | 27 | 25 |
| Type Q Fiber | 25 | 25 | 25 | 27 | 25 |
| Type R Steel Fiber | 30 | 30 | 30 | 30 | 30 |

| | Type F Welded Wire Fabric | Type G Welded Wire Fabric | Type H Welded Wire Fabric | Type I Welded Wire Fabric |
|---|---|---|---|---|
| Type P Fiber | 17 | 20 | 30 | 33 |
| Type Q Fiber | 25 | 25 | 30 | 33 |
| Type R Steel Fiber | 30 | 30 | 30 | 41 |

METHOD AND CALCULATOR FOR CONVERTING CONCRETE REINFORCING MATERIALS TO AN EQUIVALENT QUANTITY OF CONCRETE REINFORCING FIBERS

FIELD OF THE INVENTION

The invention relates to a method for converting a first input data corresponding to a property of a first material to a second type of data corresponding a property of a second type of material, the first data being an input and the second data being an output, and the relationship between the value of the first and the second data being predetermined. More specifically, the invention relates to a method of converting a first type of concrete reinforcing material data to an equivalent quantity of concrete reinforcing fibers. Even more particularly, the invention relates to a method of converting concrete reinforcing material data such as steel rebar or steel mesh data into an equivalent quantity of fibers, such as synthetic or steel fibers, for reinforcing concrete.

BACKGROUND OF THE INVENTION

Reinforced concrete is known.

It is known to reinforce concrete with steel rebar, with mesh, or with concrete reinforcing fibers, such as steel or synthetic fibers. The fibers may be synthetic microfibers or macrofibers, for example.

Concrete reinforced with fibers is termed fiber reinforced concrete (FRC). Fiber reinforced concrete (FRC) is used for controlling and reducing the initiation of and propagation of cracks in concrete.

Lightly reinforced concrete slabs are concrete slabs suitable for low static and dynamic load applications such as concrete floors in shopping centers, cultural centers, showrooms, trade fairs, and the like.

Known reinforcement of lightly reinforced slabs, such as by the use of steel rebar or mesh is often unsatisfactory. Conventional reinforcement of lightly reinforced slabs is often unsatisfactory because the steel rebar or mesh in conventional slabs is usually provided in the lower portions of the slab and, in particular, below the top one-third of the slab. That conventional placement of steel rebar and mesh reinforcing is significant because it is in the top one-third of the slab where such reinforcing would actually be most beneficial.

The conventional steel rebar or mesh that is added in the bottom two-thirds of the slab and, indeed, often in the bottom one-third of the slab, provides some measure of control of cracking of the slab at the surface.

However, there is a need to reinforce lightly reinforced slabs to avoid the cracks at the surface that appear in conventionally reinforced slabs.

Known patents for concrete reinforcing steel fibers include:

U.S. Pat. No. 6,045,910 to Lambrechts; and

U.S. Pat. No. 6,269,602 to Thooft et al.

Known indicating devices include:

U.S. Pat. No. 5,678,862 to Hughes et al.; and

U.S. Pat. No. Des. 370,494 to Hughes et al.

Known examples of devices which indicate inputs and outputs include:

Dean Foods 401(K) Plan "Scorecard/Crunching the numbers", ©2002 MFS Investment Management®, MFS Fund Distributors, Inc., Boston, Mass. 02116, USA, (DEAN-SR-04/02/12M);

Wachovia "Traveler's Check Verification", ©2002 Abagnale & Associates (800-237-7442); and Union Wire Rope "Ton-Mile Indicator", Union Wire Rope/Division of Wire Rope Corporation of America, Incorporated, St. Joseph, Mo. 64501, USA, undated.

OBJECTS AND SUMMARY OF THE INVENTION

It is an object of the invention to overcome the drawbacks of the known methods of reinforcing concrete slabs, such as lightly reinforced slabs.

Another object of the invention is to increase the tensile strength of lightly reinforced slabs.

A further object of the invention is to control the appearance of undesirable and high-maintenance cracks in concrete.

Yet another object of the invention is to provide a method of calculating an appropriate quantity of concrete reinforcing fibers to use in a fiber reinforced concrete (FRC) slab.

Another object of the invention is to provide a method of calculating an appropriate quantity of concrete reinforcing steel fibers to use in a steel fiber reinforced concrete (SFRC) slab.

Yet another object of the invention is to provide a method of determining an appropriate equivalent fiber dose which is established using the spacing theory.

Another object of the invention is to determine the appropriate equivalent fiber dose corresponding to rebar or mesh reinforcing by equating the area of steel provided by the rebar or mesh to the area of material provided by the quantity of fibers to be determined.

Another object of the invention is to determine an equivalent fiber dose corresponding to a given rebar or mesh reinforcing by equating the moment capacity of a fiber reinforced concrete (FRC) section to the moment capacity of a given rebar or mesh reinforced section.

A further object of the invention is to provide a method which is a combination of the three methods described immediately above to arrive at equivalent fiber dosages equivalent to conventional steel methods.

Yet another object of the invention is to provide a method of determining whether the slab to be reinforced is a lightly reinforced concrete slab, then determining an appropriate (e.g. desired) quantity of fiber to be used by the provision of a calculator, the calculator including a first rebar or mesh data input field and a second fiber output field, so that the user may readily determine a corresponding quantity of fibers equivalent to a given input of steel rebar or mesh.

Another object of the invention is to provide such a calculator in the form of a hand-held device having preset input and output values based on previously performed calculations.

Another object of the invention is to provide a hand-held calculator of the above type that is in the form of one physical element movable relative to another physical element, so as to readily indicate data inputs and outputs.

Yet another object of the invention is to provide a hand-held calculator of the above type in the form of two pieces of relatively movable flat material, such as two pieces of cardboard.

A further object of the invention is to provide a method of calculating concrete fiber reinforcing doses, equivalent to conventional concrete reinforcement, such as rebar and mesh, and which concrete fiber reinforcing doses can be calculated for synthetic as well as steel fibers.

Another object of the invention is to provide a hand-held calculator of the above type in the form of an electronic calculator with previously calculated outputs corresponding to inputs entered by a user.

In sum, the invention is directed to a method for converting a first type of concrete reinforcing material to an equivalent quantity of concrete reinforcing fiber for designing a reinforced concrete slab. The method may include determining whether a slab to be reinforced is a lightly reinforced slab on which loads to be carried are not excessive; and then using the spacing theory to get a minimum fiber dosage for a given concrete slab thickness, if the slab to be reinforced is a lightly reinforced slab. The user then uses an equivalent area of material calculation to determine a proper fiber dosage, if the minimum fiber dosage for a given concrete slab thickness is insufficient to give a residual strength factor greater than 30 percent. If the minimum fiber dosage for a given concrete slab thickness is sufficient to give a residual strength factor greater than 30 percent, then the user uses an equivalent moment capacity calculation to determine a proper fiber dosage. A tabulation in the form of a fiber reinforced concrete design calculator may be provided, such a fiber reinforced concrete design calculator including a first input field including a first set of data corresponding to a first type of concrete reinforcing material, and a first output field including a first set of data corresponding to a first type of concrete reinforcing fibers.

The above inventive method includes determining the equivalent fiber dosage for synthetic as well as steel fibers.

It will be appreciated that relative terms such as up, down, vertical, horizontal, left, and right, are for convenience only and are not intended to be limiting.

The term design refers to engineering design, independent of aesthetic considerations.

BRIEF DESCRIPTION OF THE DRAWINGS

FIG. 2 is a top perspective view of the inventive calculator of FIG. 1, shown in a moved position indicating further inputs and related outputs.

DETAILED DESCRIPTION OF THE INVENTION

Three Methods to Determine

The Appropriate Equivalent

Figure 1:
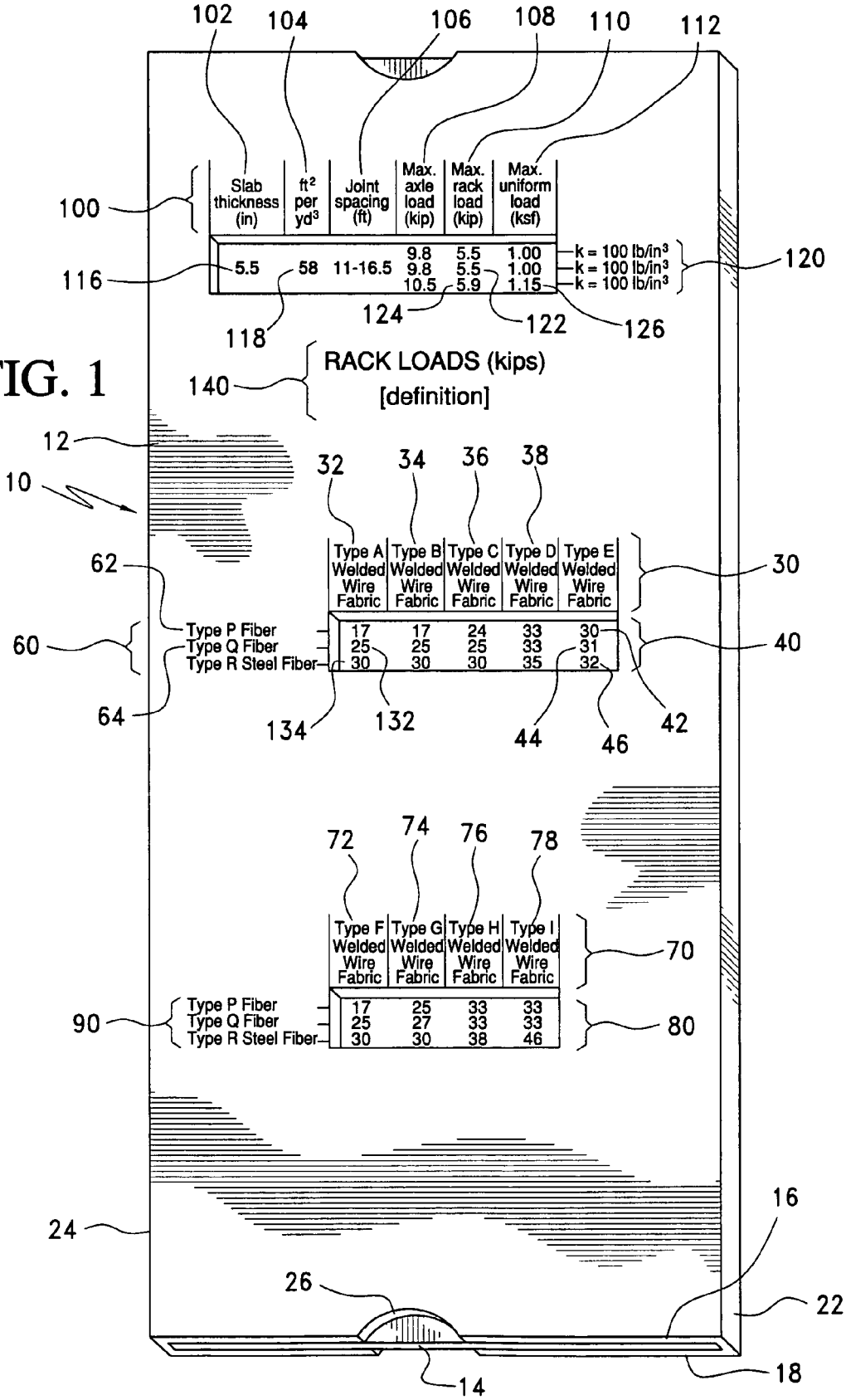
FIG. 1 is a top perspective view of a calculator according to the invention for performing a method according to the invention, the calculator showing inputs and outputs.

Fiber Dose:

The inventive method and calculator may be understood by first considering the underlying methodology.

Method 1

1. A minimum quantity of fibers is established using the spacing theory (See Mckee, D.C., "The Properties of an Expansive Cement Mortar Reinforced with Random Wire Fibers", Ph.D., Thesis, University of Illinois Urbana, Urbana, Ill., USA 1969). The theory describes how to calculate the number of steel fibers required to ensure complete coverage using the following formula:

$$SF\ \text{dose}=[1\div(0.58\times l_f)^3]\div[4\div(\pi d_f^2 l_f)\times 7850]$$

Where, $l_f$=fiber length $d_f$=fiber diameter

SF dose=steel fiber dose.

Method 2

2. A quantity of steel fibers is calculated by equating the area of steel provided by rebar or mesh to the area of steel provided by steel fibers. The equivalent cross sectional steel area is based on a method by Soroushian and Lee (See Soroushian and Lee, "Distribution and Orientation of Fibers in Steel Fiber Reinforced Concrete", *ACI Materials Journal* 87-M44, 1990) and determines the number of fibers crossing a plane per unit area using the following formula:

$$SF\ \text{dose}=A_s\times 13200\div(\alpha\times t\times 12)$$

Where, $A_s$=conventional steel area t=slab thickness

α=fiber orientation factor

SF dose=steel fiber dose.

Method 3

3. A quantity of steel fibers is calculated by equating the moment capacity of a steel fiber reinforced concrete section to the moment capacity of a conventional rebar or mesh reinforced section. The method uses yield line analysis and is described in TR-34 (See Technical Report 34 (TR 34) "Concrete Industrial Ground Floors—A Guide to Their Design and Construction", The Concrete Society, 1994). The quantity of steel fibers is calculated using the following formula:

$$M_o=M_n+M_p+[1+R_{10,50}]\times f_r\times S$$

Where, $f_r$=plain concrete modulus of rupture (4,000 psi assumed)

S=section modulus $R_{10,50}$=SFRC residual strength factor $M_n$=negative moment resistance of slab $M_p$=positive moment resistance of slab The residual strength factor is directly related to the dose of a specific steel fiber type and the concrete compressive strength. This relationship is determined from laboratory scale beam tests performed in accordance with ASTM C 1018.

How To Specify Steel Fibers, such as Dramix® Brand Steel Fibers (Dramix® is a Registered Trademark of NV Bekaert SA, Zwevegem, Belgium)

For Type I Fibers:

Steel fibers shall meet the requirements of ASTM A 820 Type I. Steel fiber content at placement shall not be less than [dosage rate] lb/yd$^3$ of Dramix® [fiber designation].

For Type V Fibers:

Steel fibers shall meet the requirements of ASTM A 820 Type V. Steel fiber content at placement shall not be less than [dosage rate] lb/yd$^3$ of Wiremix®. (Wiremix® brand fibers is a registered trademark of NV Bekaert SA, Zwevegem, Belgium)

Efficiency

A tabulation of the quantity of fibers, such as steel or synthetic fibers, which equal certain configurations of rebar and mesh, may be set forth in a calculator 10 described in detail below. The spacing theory establishes the minimum dosage.

The equivalent area of steel method is used when the dosage of steel fibers, for example, is not sufficient to produce a residual strength factor greater than 30%.

The equivalent moment capacity method is used when the dosage of fibers, such as steel fibers, suffices to produce a residual strength factor greater than 30.

It must be emphasized that when using FRC, SFRC, mesh or rebar for lightly reinforced slabs, control joint dimensions must be chosen using PCA (Portland Cement Association, Washington, D.C. 20036, USA; http://www.cement.org) and ACI (American Concrete Institute, Farmington Hills, Mich. 48331 USA; http://www.aci-int.org) guidelines or other local code requirements assuming no reinforcement is present.

Calculator Embodying the Method

FIGS. 1 and 2 illustrate an embodiment of a tabulation of reinforced concrete material specification or design data in the form of a calculator 10 according to the inventive method described above.

Calculator 10 may be in the form of a chart, or in the form of a first element or cover 12 and a second element or insert 14 which is movable relative to first element or cover 12.

As will be readily appreciated the various data fields and pieces of data shown in the data fields may be calculated in advance, as shown, for ease of use by the user of calculator 10.

For ease of use, first element 12 may include a front panel 16 and a rear panel 18 joined together by a side portion 22 and an optional further side portion 24. Conveniently, first element 12 may be in the form of a sheet of plastic or cardboard, and a connection or side or joint 22 may be a fold in the cardboard which joins face 16 to rear 18 and envelops slidable slot element 14. A partially removed portion 26 may be provided so that a portion of element 14 may be readily grasped by a finger of a user.

Calculator 10 may include a first data field 30 corresponding to a first type of concrete reinforcing material, such as the illustrated "Welded Wire Fabric". Data field 30 may include one or more subfields 32, 34, 36, and 38, for example. Subfield 32 may correspond to a first type of welded wire fabric; e.g. Type A, as shown. Field 30 may include collectively, for example, different types of 6"×6" welded wire fabric. Type A welded wire fabric may be W1.4/10 gage 6"×6" welded wire fabric. Subfield 34 Type B welded wire fabric may be, for example, W2/8 gage 6"×6" welded wire fabric.

A further data field 40 may correspond to a quantity (e.g. in pounds or kilograms) of a second type of concrete reinforcing material. Individual pieces of data in individual subfields may include data 42, 44, and 46, as shown.

This type of data 42, 44, 46 may be considered an output based on inputs (e.g. concrete slab specification data) described above and below. For example, a further data field 60 may include various types of concrete reinforcing fibers, such as synthetic or steel fibers, for use in producing fiber reinforced concrete (FRC), such as the illustrated subfield 62 showing "Type P Fiber" and further data field 64 illustrating "Type Q Fiber".

Yet another input data field 70 may be provided including subfields 72, 74, 76, and 78, for example, corresponding to yet another basic type of reinforcing material, and subtypes within that basic type shown in the various subfields 72-78. For example, data field 70 may be considered an input data field corresponding to 4"×4" welded wire fabric, or, indeed, additional types of 6"×6" welded wire fabric, in the case where data field 30 corresponds to 6"×6" welded wire fabric. Again, discrete data points may be shown in an output data field 80, such output data field 80 corresponding to quantities (e.g. pounds or kilograms) of another type of concrete reinforcing material, such as the illustrated different types of fibers shown in data field 90.

Still further, additional concrete construction specifications, such as the type, thickness, expected static and dynamic loads, joint spacing, and the like may be provided in a concrete slab specification data field 100, as shown.

A subfield or data field 102 may designate slab thickness (in inches or millimeters), a subfield 104 may conveniently provide a pre-calculated conversion of square feet per cubic yard or square meters per cubic meter, a subfield 106 may designate joint spacing (e.g. in feet or meters). In addition, a subfield 108 may be used for indicating an expected maximum axle load (in kips or kiloNewtons), a data field 110 may indicate an expected maximum rack load (in kips or kiloNewtons), and a further data field 112 may indicated an expected maximum uniform load (in kips per square foot or Newtons per square millimeter).

A piece of input data 116, such as the "5.5" shown in FIG. 1, may correspond to an expected design slab thickness of 5.5 inches.

If the user contemplated constructing a 5.5 inch slab, the user could readily determine that such a 5.5 inch slab would cover 58 square feet for every cubic yard of concrete that the user poured, as designated by reference number 118.

Additional data field or subfield 120 may include additional pieces of input or output data 122 and 124, depending on one's point of view. That is, it may be appreciated that with an expected slab thickness of 5.5 inches and an expected maximum uniform load of 1.15 kips per square foot (ksf) as shown by data 126, one may likewise expect a maximum rack load of 5.9 kips could be carried by the 5.5 inch slab, as indicated by data 124.

Given those expected inputs in fields 116 and 120, and related subfields, the user may readily determine that if the user had anticipated using Type A welded wire fabric of field 32, then the user could use instead an equivalent quantity of Type Q fibers as shown in data field 64, the equivalent quantity being 25 pounds of Type Q fiber as indicated by data 132.

If, instead, the user wanted to know what the equivalent quantity of Type R steel fiber would be, the user could readily determine that 30 pounds of Type R steel fiber would correspond to 25 pounds of Type Q fiber. The 30 pounds of Type R steel fiber being designated 134 and the 25 pounds of Type Q fiber being designated 132. Quite simply, as will be readily apparent, the user need simply to read down in the column below data field 32 and read across to the right in data field 60 and the intersection between the corresponding vertical and horizontal lines, respectively indicate the data point in question. As yet another example, if one reads down vertically in the column corresponding to subfield 32 and if one reads horizontally across to the right in the row corresponding to Type P fiber data subfield 62, the intersection will read "17", 17 corresponding to 17 pounds of Type P fiber being equivalent (i.e. yielding an equivalent strength to the reinforced concrete) to the Type A welded wire fabric.

The subfields or fields 70, 80, 90, and the like may be used in an analogous fashion.

A field 140 may be provided as an informational field, such as the illustrated field 140 showing "RACK LOADS (kips) [definition]" indicating that the definition of rack load could be provided on calculator 10 itself, for ready reference by the user.

Still further, in use, the user may desire, based on expected slab loads, that a slab thickness of 7 inches is required. Please see FIG. 2 in which 156 designates a 7 inch slab thickness.

In use, it will be seen that a user may readily move second element or insert 14 in the direction of an arrow 150 for locating further pieces of data in different data fields, such as the illustrated slab thickness of 7 inches being shown as data input 156. Alternately, one might consider the expected maximum uniform load of 1.30 ksf as the expected maximum load, the expected maximum load being designated 158. The slab thickness of 7 inches suffices to carry that maximum expected uniform load of 1.30 ksf, assuming the maximum axle loads and rack loads are at most the maximum loads indicated by data points 162 and 164, respectively.

Thus, once the slab thickness has been designated, the user can again, as described above, readily determine that 30 pounds of Type R steel fiber (designated 166) is equivalent to a given quantity of Type A welded wire fabric, 25 pounds of Type Q fiber (designated element 168) is equivalent to that same Type A welded wire fabric, and 17 pounds of Type P fiber (designated 172) is likewise equivalent to that given quantity of Type A welded wire fabric. The given quantity of Type A welded wire fabric may be 6"×6" steel wire mesh of a given gage, for example.

It will thus be seen that the inventive method and related calculations are readily calculated in advance and put in a form easily usable by the user. The form of tabulating the results of the inventive method may be calculator 10, as shown, with two relatively moveable parts, one slidable relative to the other; i.e. cover 12 being movable relative to insert 14, and vice versa.

The relatively moveable components may be in the form of other shapes, such as discs and the like, any shape including data fields which may be readily aligned and displayed.

Additional data fields are expected, such as metric units (SI units) being shown on cover 16, or on the rear 18, for example. The English units and metric units may be aligned so that if one aligns a desired English unit, one may readily look at another exposed field on the front or on the rear of the device, and immediately see the equivalent metric unit without further manipulation of the calculator.

It is likewise contemplated that the calculator be in an electronic form, with the calculations already performed, or the algorithm stored in a dedicated chip, for example, so that the user simply needs to enter a slab thickness and expected load, for example, and the calculations in accordance with the inventive method are carried out to reveal displayed results in one or more electronic calculator displays that show equivalents in wire mesh and fibers, such as synthetic and steel fibers. It will be appreciated that various designated buttons could be provided on such a calculator so that the user need simply to press buttons labeled slab thickness, synthetic fibers, steel fibers, types of steel fiber, microfibers, macrofibers, steel mesh, rebar, and the like.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

What is claimed is:

1. A method for converting a first type of concrete reinforcing material to an equivalent quantity of concrete reinforcing fiber for designing a reinforced concrete slab, the reinforced concrete slab using the concrete reinforcing fiber instead of the first type of concrete reinforcing material, comprising:

a) determining whether a slab to be reinforced is a lightly reinforced slab on which loads to be carried are not excessive;

b) using the spacing theory to get a minimum fiber dosage for a given concrete slab thickness, if the slab to be reinforced is a lightly reinforced slab;

c) using an equivalent area of steel calculation to determine a proper fiber dosage, if the minimum fiber dosage for a given concrete slab thickness is insufficient to give a residual strength factor greater than 30 percent;

d) using an equivalent moment capacity calculation to determine a proper fiber dosage, if the minimum fiber dosage for a given concrete slab thickness is sufficient to give a residual strength factor greater than 30 percent; and e) providing a tabulation in the form of a fiber reinforced concrete design calculator, the fiber reinforced concrete design calculator including:

1) a first input field including a first set of data corresponding to a first type of concrete reinforcing material; and 2) a first output field including a first set of data corresponding to a first type of concrete reinforcing fibers to be used instead of the first type of concrete reinforcing material for designing a reinforced concrete slab.

2. A method as in claim 1, wherein:

a) the fiber reinforced concrete design calculator includes:

1) a first element; and 2) a second element, the second element being movable relative to the first element.

3. A method as in claim 2, wherein:

a) the fiber reinforced concrete design calculator includes:

1) the first input field is provided on the first element; and 2) the first output field is provided on the second element.

4. A method as in claim 3, wherein:

a) the fiber reinforced concrete design calculator includes:

1) a first concrete slab input field including a first set of concrete input slab data corresponding to a first parameter of a reinforced concrete slab to be designed; and 2) a first concrete slab output field including a first set of concrete output slab data corresponding to and determined by the first set of concrete input slab data.

5. A method as in claim 4, wherein:

a) the first set of concrete input slab data includes slab thickness data.

6. A method as in claim 2, wherein:

a) the first input field and the first output field being located so that when the first element is moved relative to the second element, the first output field shows the first set of data corresponding to the first type of concrete reinforcing fibers which correspond to the first type of concrete reinforcing material data in the first input field, in use.

7. A method as in claim 6, wherein:

a) the fiber reinforced concrete design calculator includes:

1) a second data field, the second data field including at least two predetermined data points, the values of each of the at least two predetermined data points corresponding to and dictated by the first input;

2) a third data field, the third data field including at least two predetermined data points, and 3) the value of the at least two predetermined data points in the third data field corresponding to and dictated by the first input.

8. A method as in claim 2, wherein:

a) the first element includes a first flat object.

9. A method as in claim 2, wherein:

a) the first element includes a second flat object.

10. A method as in claim 1, wherein:

a) the first type of concrete reinforcing fibers in the first output field includes synthetic fibers.

11. A method as in claim 1, wherein:

a) the first type of concrete reinforcing material in the first input field includes rebar.

12. A method as in claim 1, wherein:

a) the first type of concrete reinforcing material in the first input field includes mesh.

13. A method as in claim 12, wherein:

a) the first type of concrete reinforcing material in the first input field includes rebar.

14. A method as in claim 1, wherein:

a) the first type of concrete reinforcing fibers in the first output field includes steel fibers.

15. A method as in claim 1, wherein:

a) the first type of concrete reinforcing material in the first input field includes mesh; and b) the first type of concrete reinforcing fibers in the first output field includes synthetic fibers.

16. A method as in claim 1, wherein:

a) the first type of concrete reinforcing material in the first input field includes mesh; and b) the first type of concrete reinforcing fibers in the first output field includes steel fibers.

17. A method as in claim 1, wherein:

a) the first type of concrete reinforcing material in the first input field includes rebar; and b) the first type of concrete reinforcing fibers in the first output field includes steel fibers.

18. A method as in claim 1, wherein:

a) the first type of concrete reinforcing material in the first input field includes rebar; and b) the first type of concrete reinforcing fibers in the first output field includes synthetic fibers.

* * * * *